US006286904B1

(12) United States Patent
Obertelli et al.

(10) Patent No.: US 6,286,904 B1
(45) Date of Patent: Sep. 11, 2001

(54) PIVOTABLE ABDUCTION ABUTMENT SUPPORT FOR WHEELCHAIR OR THE LIKE

(76) Inventors: Bernard Obertelli, 310 St-Pierre, St-Jean-de-Matha Québec (CA), J0K 2S0; Jacques Harnois, 18, rue Lavallée, Sainte-Mélanie Québec (CA), J0K 3A0

( * ) Notice: Subject to any disclaimer, the term of this patent is extended or adjusted under 35 U.S.C. 154(b) by 0 days.

(21) Appl. No.: 09/500,878

(22) Filed: Feb. 9, 2000

(51) Int. Cl.[7] ..... A47C 31/00
(52) U.S. Cl. ..... 297/467; 297/423.19; 297/DIG. 4
(58) Field of Search ..... 297/467, 403, 297/DIG. 4, 423.1, 423.17, 423.26, 423.19, 423.28, 423.29, 423.3

(56) References Cited

U.S. PATENT DOCUMENTS

| | | | | |
|---|---|---|---|---|
| 4,165,127 | * | 8/1979 | Vago | 297/423.19 X |
| 4,192,546 | * | 3/1980 | Smith | 297/423.17 X |
| 5,320,416 | * | 6/1994 | Kornberg | 297/467 |
| 5,636,900 | * | 6/1997 | Wilkie et al. | 297/423.19 |

FOREIGN PATENT DOCUMENTS

| | | | | |
|---|---|---|---|---|
| 2150525 | * | 4/1972 | (DE) | 297/467 |
| 1595570 | * | 8/1981 | (GB) | 297/DIG. 4 |

OTHER PUBLICATIONS

1999 Catalog of Adaptive Engineering Lab, Lever Release Abductor Bracket, pp. 52–53.
Advertisement of Otto Bock, Seat Cushions—Wheelchair Interface.
Description of Promed's Support De Butée D'Adduction à Bascule.

* cited by examiner

*Primary Examiner*—Laurie K. Cranmer
(74) *Attorney, Agent, or Firm*—St. Onge Steward Johnston & Reens

(57) ABSTRACT

A pivotable abduction abutment support for a wheelchair or the like is disclosed. The support of the invention has a base member adapted to be fastened under the seat of the wheelchair or the like. The support also has a rod having two opposite ends, one end being mounted about a first pivot located on the base member and having a pivoting axis parallel to a front edge of the seat, and the other end having an abutment fastened to it. The rod can pivot between an upstanding position where the rod extends upwardly and substantially vertically, and a released position where the rod extends downwardly. The support further includes a releasable locking mechanism for releasably locking the rod in the upstanding position, which consists of (i) a retaining portion for engaging the front surface of the rod, the retaining portion lying above the first pivot in order to lock the rod in the upstanding position, (ii) at least one arm extending rearwardly from the retaining portion and having a distal end mounted about a second pivot located on the base member rearwardly of the first pivot, and (iii) a spring for biasing the retaining portion against the rod. By manually pivoting the retaining portion away from the rod, the rod is released and free to pivot downwardly. When the rod is pivoted from the released position to the upstanding position, the spring automatically pivots the retaining portion towards the rod to engage the front surface of the rod and thereby lock the rod in the upstanding position. Alternatively, the retaining portion can be adapted to pivot away from the rod about a pivoting axis parallel to the one of the rod or about a vertical pivoting axis.

10 Claims, 9 Drawing Sheets

PIVOTABLE ABDUCTION ABUTMENT SUPPORT FOR WHEELCHAIR OR THE LIKE

FIELD OF THE INVENTION

The present invention relates to a pivotable abduction abutment support for preventing injury during the abduction movement of the legs of a handicapped person sitting on a chair, a wheelchair, a base on wheels, or the like.

BACKGROUND OF THE INVENTION

Some handicapped persons have muscular contraction problems that make them contract their legs together (this movement is known as abduction) and hit their knees. Such contraction can hurt them involuntarily and to prevent this, there are different abduction abutment supports. The support places the abutment between the legs of the person and prevents the knees from hitting each other. Some known abutment supports are fixed to the seat, such as the one described in Wilkie et al. U.S. Pat. No. 5,636,900, and may not pivot downwardly in order to be moved out of the way of the person when it is necessary.

Other known abutment supports may pivot downwardly to clear the way of the person sitting on the wheelchair so he or she can move out or move on the wheelchair easily. These pivotable abutment supports are provided with a locking mechanism that locks the abutment between the legs of the person and can be unlocked in order to move the abutment out of the way when desired.

The locking means of one known pivotable abutment support comprises a protuberance on one side of a lower end of a rod and two plates sandwiching the lower end of the rod. One plate has a recessed area adapted to receive the protuberance. An abutment is mounted on an upper end of the rod. When the rod is extended upwardly and the abutment lies above the seat, the protuberance fits into the recessed area and maintains the rod in the upstanding position, i.e. between the legs of the person. To unlock the rod, one has to press behind the abutment and pivot the rod downwardly so that the protuberance disengages the recessed area. One of the disadvantages of this locking means is that the protuberance is subject to wear and tear rapidly and consequently loses its effectiveness very rapidly.

The pivotable abutment support described in Kornberg U.S. Pat. No. 5,320,416 has a different locking mechanism to keep the rod between the legs (or knees) of the person. Its locking mechanism comprises a rail system designed to longitudinally forwardly and rearwardly adjust the abutment location, a sliding member fixed to a rod on which an abutment is mounted and adapted to slide in the rail system. At a forward limit position of the rail system, the sliding member disengages the rail and may freely pivot downwardly together with the rod and the abutment that are fastened to the sliding member. To keep the rod upwardly extending, the sliding member has to be pushed rearwardly in order to engage the rail. Then, the sliding member is secured in a longitudinal desired position on the rail system by a locking pin engaging it.

The pivotable abutment support described in Suhre U.S. Pat. No. 4,617,919 uses another locking means which comprises a release pin allowing the rod to pivot downwardly.

There is a need for a locking means for a pivotable abduction abutment support that does not wear and tear easily, and is simple to manipulate. Advantageously, the locking means is unlocked by using only one hand, and is locked automatically when the rod is pivoted back into the upstanding position.

SUMMARY OF THE INVENTION

The present invention is directed to a pivotable abduction abutment support for a chair or the like that satisfies the above-mentioned needs.

In accordance with the present invention, this object is achieved with a pivotable abduction abutment support for a chair. The chair has a seat. The support comprises:

a base member adapted to be fastened under the seat, the seat having a front edge, the base member having a front end extending beyond the front edge of the seat;

a rod having two opposite ends, a front surface and a rear surface, one of the opposite ends being mounted about a first pivot located at the front end of the base member, the first pivot having a pivoting axis parallel to the front edge of the seat, wherein the rod pivots between an upstanding position where the rod extends upwardly and substantially vertically, and a released position where the rod extends downwardly;

abutment fastening means for fastening an abutment to the other opposite end of the rod so that the abutment extends above the seat when the rod is in the upstanding position; and releasable locking means for releasably locking the rod in the upstanding position, the locking means comprising:

(i) a retaining portion for engaging the front surface of the rod, the retaining portion lying above the first pivot in order to lock the rod in the upstanding position, (ii) at least one arm extending rearwardly from the retaining portion, the arm having a distal end mounted about a second pivot located on the base member rearwardly of the first pivot, and (iii) biasing means for biasing the retaining portion against the rod, whereby, by manually pivoting the retaining portion away from the rod, the rod is released and free to pivot downwardly; and when the rod is pivoted from the released position to the upstanding position, the biasing means automatically pivots the retaining portion towards the rod to engage the front surface of the rod and thereby lock the rod in the upstanding position.

In accordance with the present invention, this object is also achieved with another pivotable abduction abutment support for a chair having a seat. The support comprises:

a base member adapted to be fastened under the seat, the seat having a front edge, the base member having a front end extending beyond the front edge of the seat, the front end having a front surface and a lower surface where the front surface is inwardly rounded towards the lower surface, the base member having two opposite sides;

a rod having two opposite ends, a front surface and a rear surface, one of the opposite ends being mounted about a first pivot located at the front end of the base member, the first pivot having a pivoting axis parallel to the front edge of the seat, wherein the rod pivots between an upstanding position where the rod extends upwardly and substantially vertically, and a released position where the rod extends downwardly;

abutment fastening means for fastening an abutment to the other opposite end of the rod so that the abutment extends above the seat when the rod is in the upstanding position;

releasable locking means for releasably locking the rod in the upstanding position, the locking means comprising:

(i) a retaining portion for engaging the front surface of the rod, the retaining portion lying above the first pivot in order to lock the rod in the upstanding position, (ii) two arms extending rearwardly from two opposite sides of the retaining portion so that the locking means defines a U shape, each arm having a distal end mounted about a second pivot located on the base member rearwardly and upwardly of the first pivot, the second pivot having a pivoting axis parallel to the pivoting axis of the first pivot, and (iii) biasing means for upwardly biasing the retaining portion, whereby, by manually pivoting down the retaining portion, the rod is released and free to pivot downwardly; and when the rod is pivoted from the released position to the upstanding position, the biasing means automatically pivot the retaining portion upwardly to engage the front surface of the rod and thereby lock the rod in the upstanding position; and two flanges laterally extending from an upper edge of the two opposite sides of the base member respectively, whereby the flanges prevent the locking means from pivoting upwardly beyond a horizontal position.

DETAILED DESCRIPTION OF PREFERRED EMBODIMENTS OF THE INVENTION

A pivotable abduction abutment support (10) according to the present invention is designed to be installed underneath a seat (1) of a chair. The term "chair" is used in the context of the present invention to designate a typical chair, a wheelchair, a base on wheels, or any other chair-like device. However, the support (10) of the present invention is particularly useful for a person sitting on a wheelchair (not shown).

Figure 1:
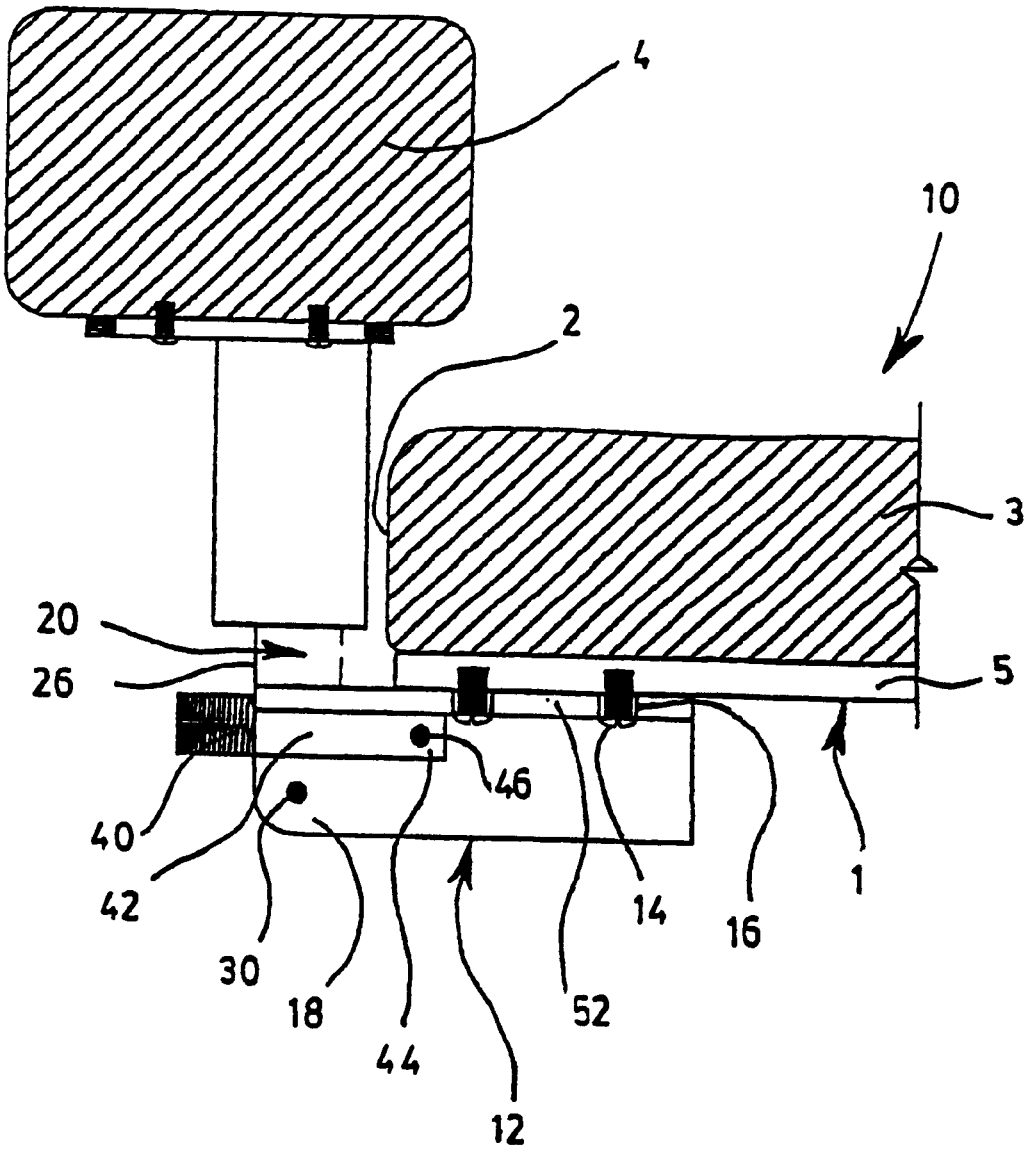
FIG. 1 is a side elevational view of the pivotable abduction abutment support according to a first preferred embodiment of the present invention, where the rod is in the upstanding position.

Referring to FIG. 1, the pivotable abduction abutment support (10) comprises a base member (12) adapted to be fastened under the wheelchair's seat (1). Usually, the seat (1) includes a rigid part (5) and a cushion part (3) as indicated in FIG. 1. Preferably, the base member (12) is fastened under the seat (1) by means of screws (14) being inserted across holes (16) made in the base member (1) and screwed to the seat (1). The seat (1) has a front edge (2), and the base member (1) has a front end (18) extending beyond the front edge (2) of the seat (1).

Figure 2:
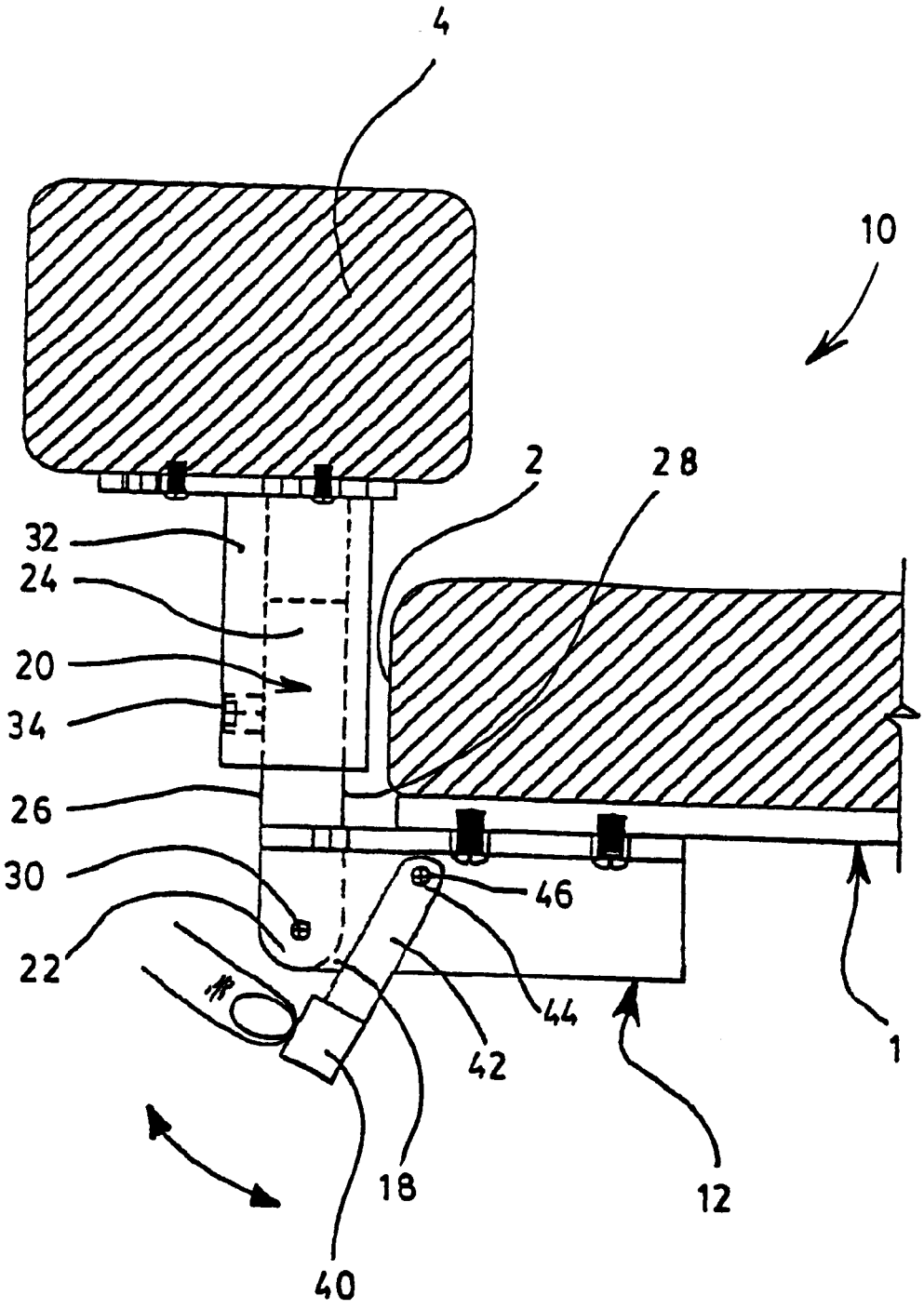
FIG. 2 is a side elevational view of the support shown in FIG. 1, where the locking means is unlocked.
Figure 4:
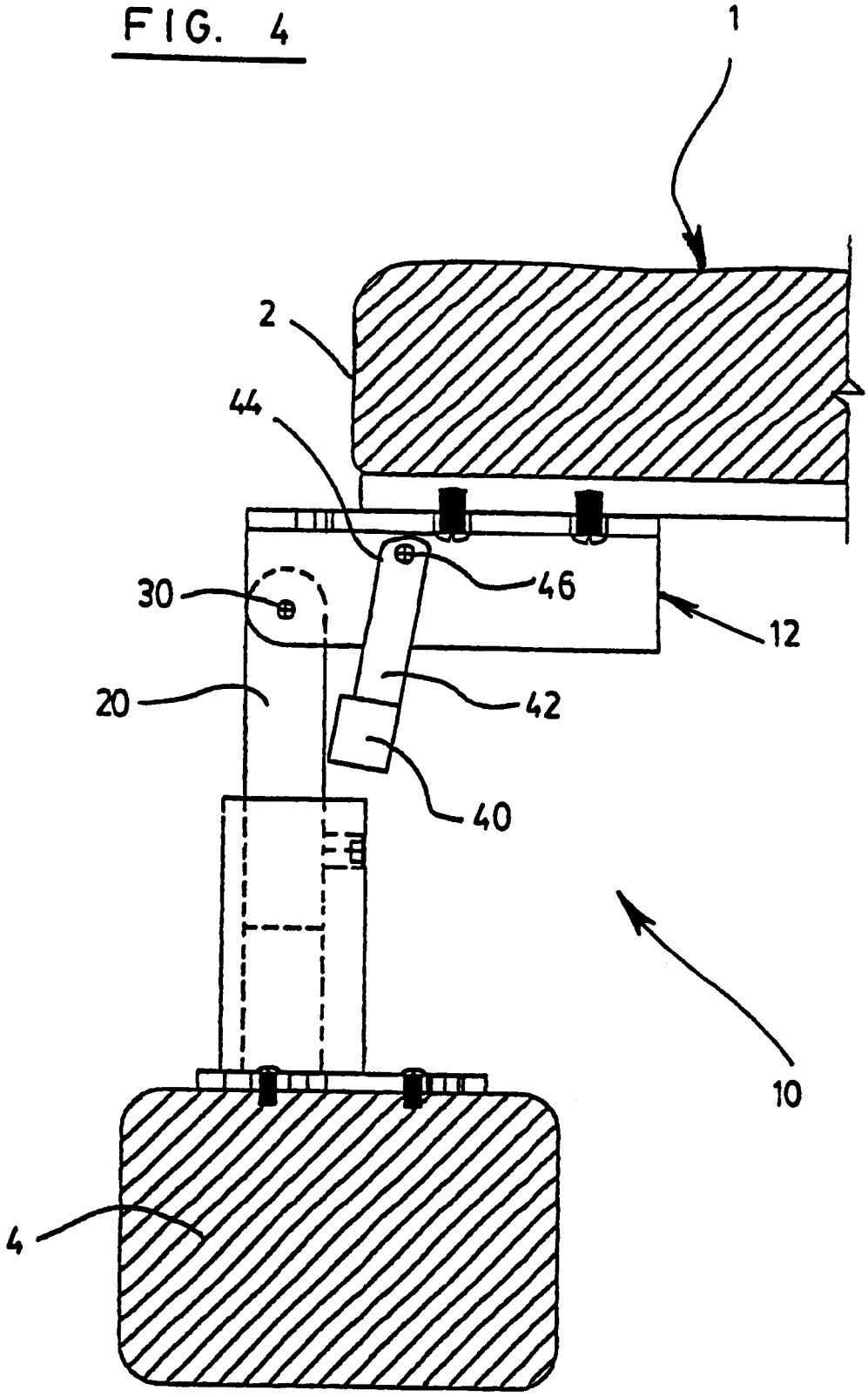
FIG. 4 a side elevational view of the support shown in FIGS. 1, 2 and 3, where the rod is in the released position.
Figure 5:
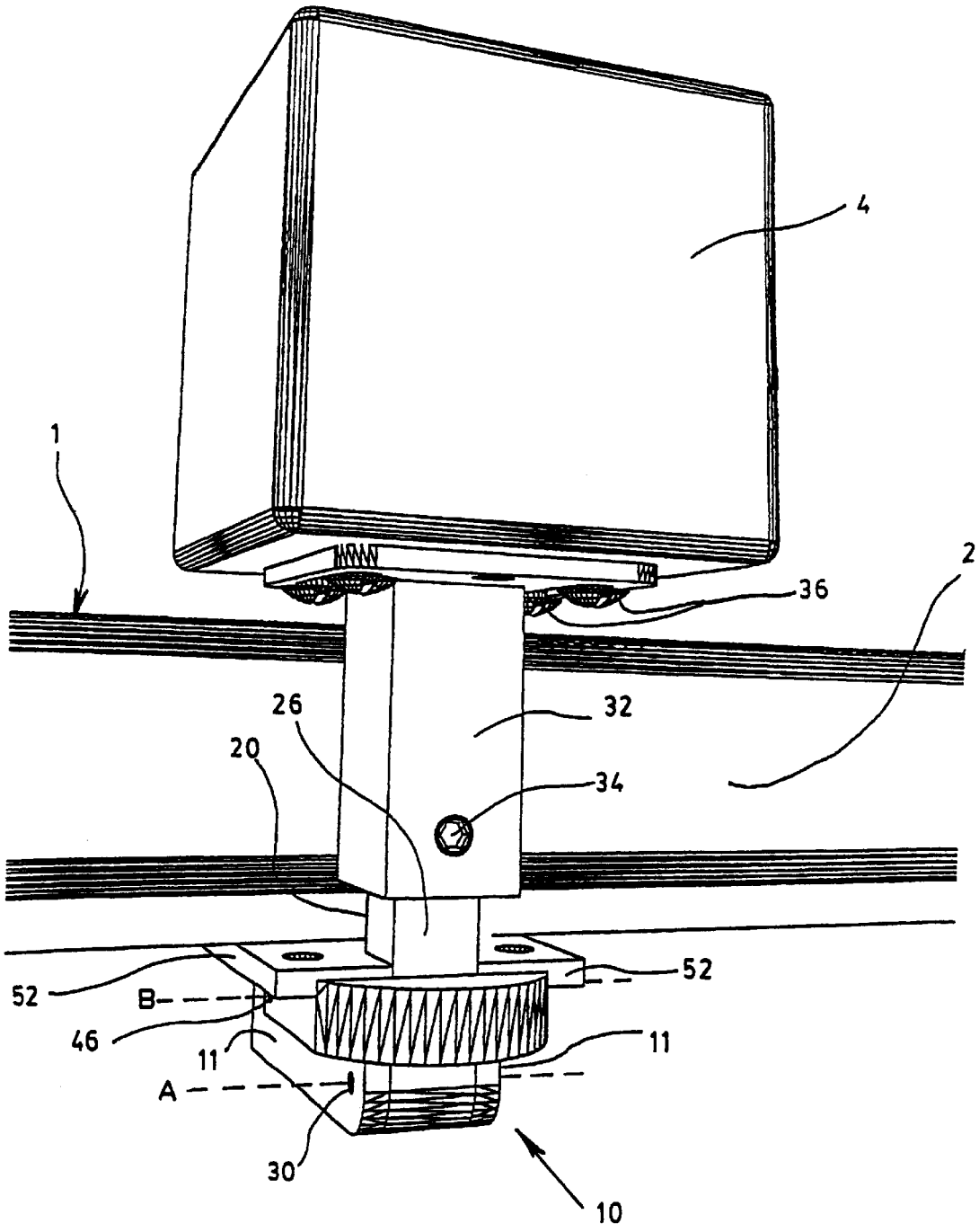
FIG. 5 is a side front perspective view of the support shown in FIGS. 1, 2, 3 and 4, mounted on a wheelchair seat.

Referring to FIG. 2, the support (10) further comprises a rod (20) having two opposite ends (22 and 24), a front surface (26) and a rear surface (28). One of the opposite ends (22) of the rod (20) is mounted about a first pivot (30) located at the front end (18) of the base member (12). The first pivot (30) has a pivoting axis A parallel to the front edge (2) of the seat (1) as illustrated in FIG. 5, so that the rod (20) can pivot between an upstanding position (shown in FIGS. 1 and 5) where the rod (20) extends upwardly and substantially vertically, and a released position (shown in FIG. 4) where the rod (20) extends downwardly. It should be understood by the expression "substantially vertically" characterising the rod (20) in the upstanding position, that a strict vertical orientation of the rod (20) is not an essential requirement of the invention. What is essential is that the abutment (4) lies between the user's legs.

Referring to FIG. 2, the support (10) also comprises abutment fastening means for fastening an abutment (4) to the other opposite end (24) of the rod (20) so that the abutment (4) extends above the seat (1) when the rod (20) is in the upstanding position. Preferably, the abutment fastening means are embodied by a hollow piece (32) covering the other opposite end (24) of the rod (20) and being maintained at a desired height along the rod (20) by means of a tightening bolt (34) extending inwardly and frictionally engaging one of the surfaces of the rod (20). Still according to this preferred embodiment of the abutment fastening means, an abutment (4) is mounted on the hollow piece (32) by means of screws (36).

Preferably, the rod (20) has a variable height in order to vertically adjust the height of the abutment (4). One way to vertically adjust the abutment (4) is to use a telescopic rod. Alternatively, the rod (2) will be supplied with a predetermined length, which is long, and can be appropriately shortened for the user and the chair for which it is intended (in this case, the rod is not adjustable per se).

Now referring to FIGS. 1 to 6, the support (10) comprises releasable locking means for releasably locking the rod (20) in the upstanding position. The locking means basically comprise (i) a retaining portion (40) for engaging the front surface (26) of the rod (20), (ii) at least one arm (42) extending rearwardly from the retaining portion (40) and being pivotally mounted on the base member (12) and (iii) biasing means for biasing the retaining portion (40) against the rod (20).

By manually pivoting the retaining portion (40) away from the rod (20), the rod (20) is released and free to pivot downwardly. When the rod (20) is pivoted from the released position (shown in FIG. 4) to the upstanding position (shown in FIG. 1), the biasing means automatically pivot the retaining portion (40) towards the rod (20) to engage the front surface (26) of the rod (20) and thereby lock the rod (20) in the upstanding position.

More particularly, the retaining portion (40) engages the front surface (26) of the rod (20) and lies above the first pivot (30) in order to lock the rod (20) in the upstanding position as shown in FIG. 1.

Referring more particularly to FIGS. 1, 2, 3 and 4, the at least one arm (42) extends rearwardly from the retaining portion (40) and has a distal end (44) mounted about a second pivot (46). It is to be understood that the at least one arm (42) can have a shape different than the one suggested in the FIGS. 1 to 4 without departing from the scope of the invention.

Figure 3:
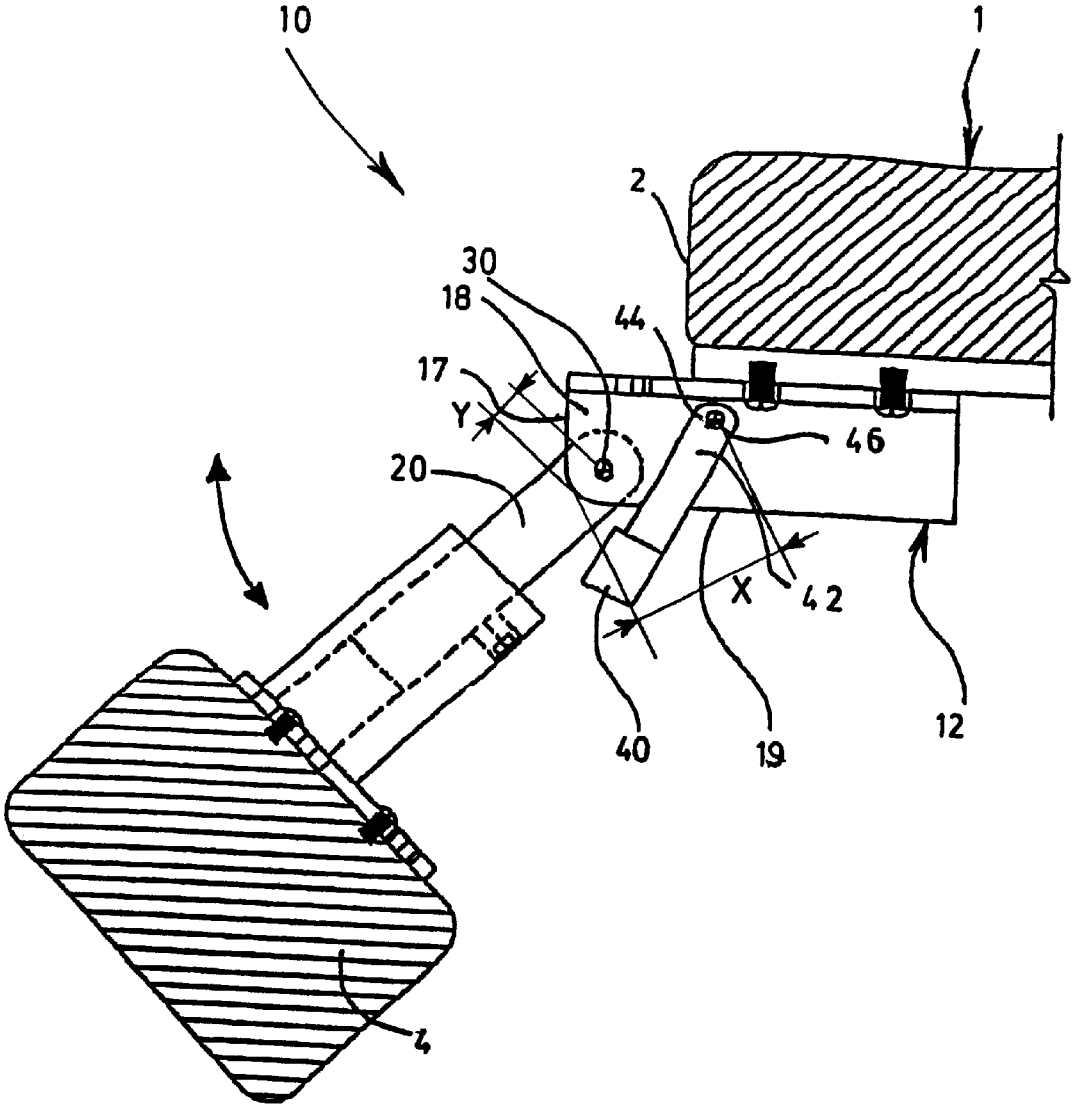
FIG. 3 is a side elevational view of the support shown in FIGS. 1 and 2, where the rod is partially pivoted downwardly.

Now referring to FIG. 3, the second pivot (46) is located on the base member (12) rearwardly of the first pivot (30) so that the pivoting radius X of the retaining portion (40) is greater than the pivoting radius Y of the rod (20). Because of this requirement, the rod (20) can not push the retaining portion (40) and force it to pivot downwardly.

Figure 6:
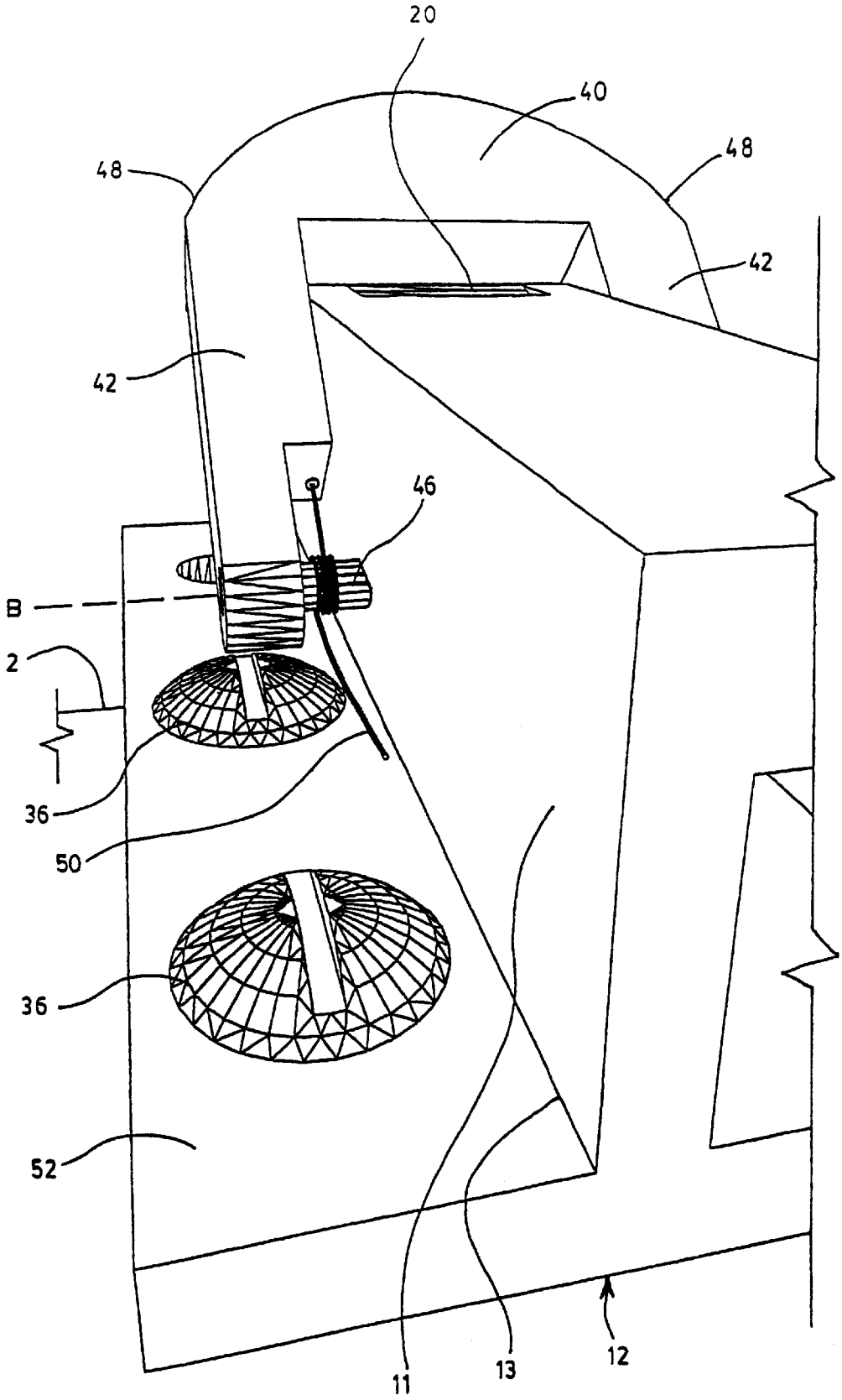
FIG. 6 is a rear bottom perspective view of a portion of the support shown in FIGS. 1, 2, 3, 4 and 5, where the locking means is partially pivoted downwardly.

According to a first preferred embodiment of the invention, the locking means comprise two arms (42) extending rearwardly from two opposite sides (48) of the retaining portion (40) so that the locking means define a U shape as more clearly shown in FIG. 6. Thus, the U shape of the locking means partially surrounds the rod (20) when the rod (20) is locked in the upstanding position, Still according to the first preferred embodiment of the invention which is shown in FIGS. 1 to 6, the second pivot (46) has a pivoting axis B parallel to the pivoting axis A of the first pivot (30); the pivoting axis A and B being specifically illustrated in FIG. 5. In the first preferred embodiment of the invention, the second pivot (46) is preferably also located above. of the first pivot (30).

Referring to FIG. 6, the biasing means is preferably a spring (50) coiled around the pivot (46). The spring (50) has one end leaning on the base member (12) and another end fixed into one arm (42) of the locking means. However, alternative configurations for a spring or any other biasing means would fall within the scope of the invention.

Now referring to FIG. 3, the front end (18) of the base member (12) has a front surface (17) and a lower surface (19) and the front surface (17) is preferably inwardly rounded towards the lower surface (19).

Now referring to FIGS. 5 and 6, the base member (12) preferably has two opposite sides (11) and comprises at least one flange (52) laterally extending from an upper edge (13, shown only in FIG. 6) of an opposite side (11) of the base member (12), whereby the flange (52) prevents the locking means from pivoting upwardly beyond a horizontal position. Preferably, the base member (12) comprises two flanges (52) laterally extending from an upper edge (13) of the two opposite sides (11) of the base member (12) respectively. These flanges (52) are preferably used to include the holes (16) for fastening the base member (12) under the seat (1).

Figure 7:
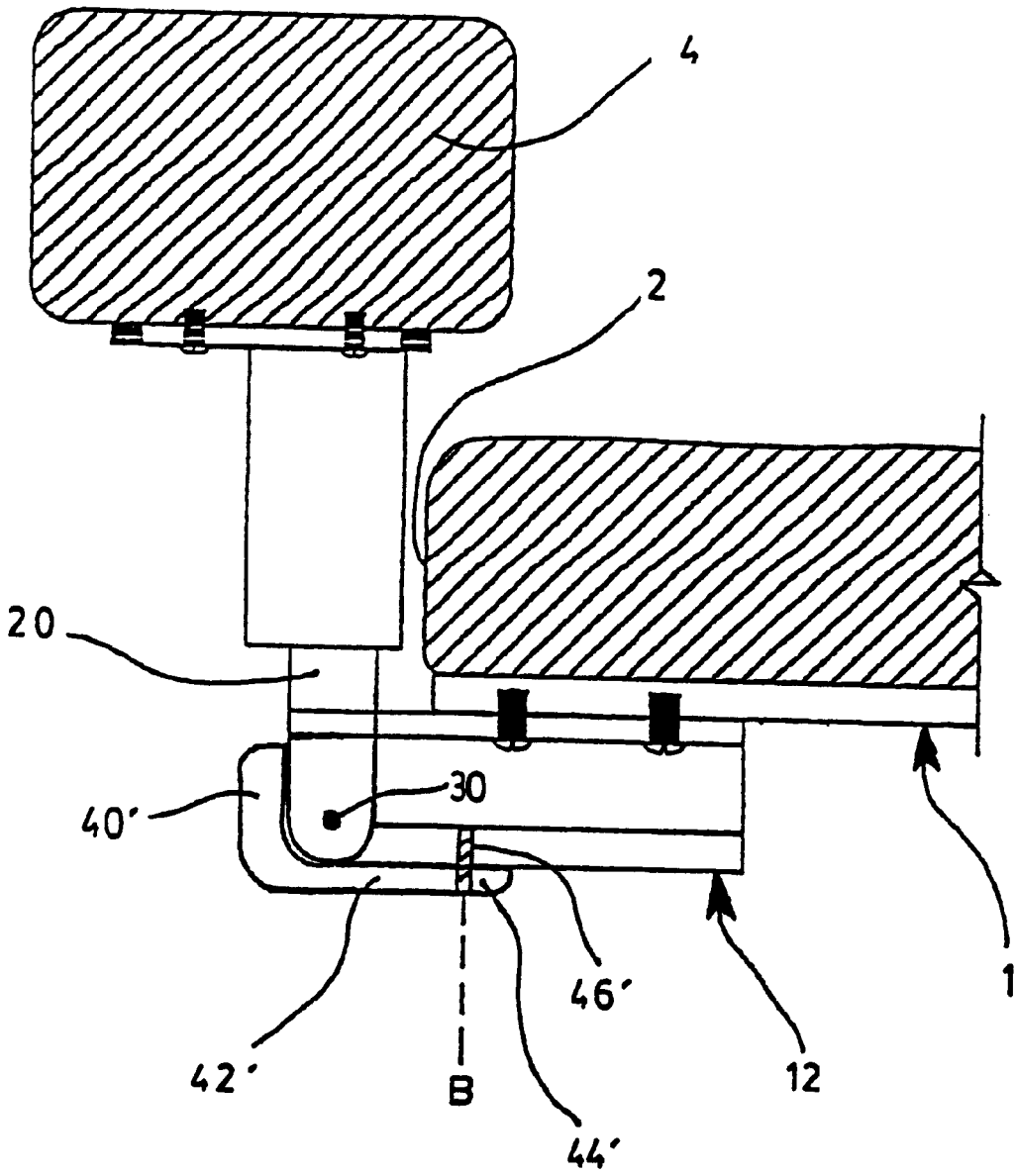
FIG. 7 is a side elevational view of the support according to a second preferred embodiment of the present invention, where the rod is in the upstanding position.
Figure 8:
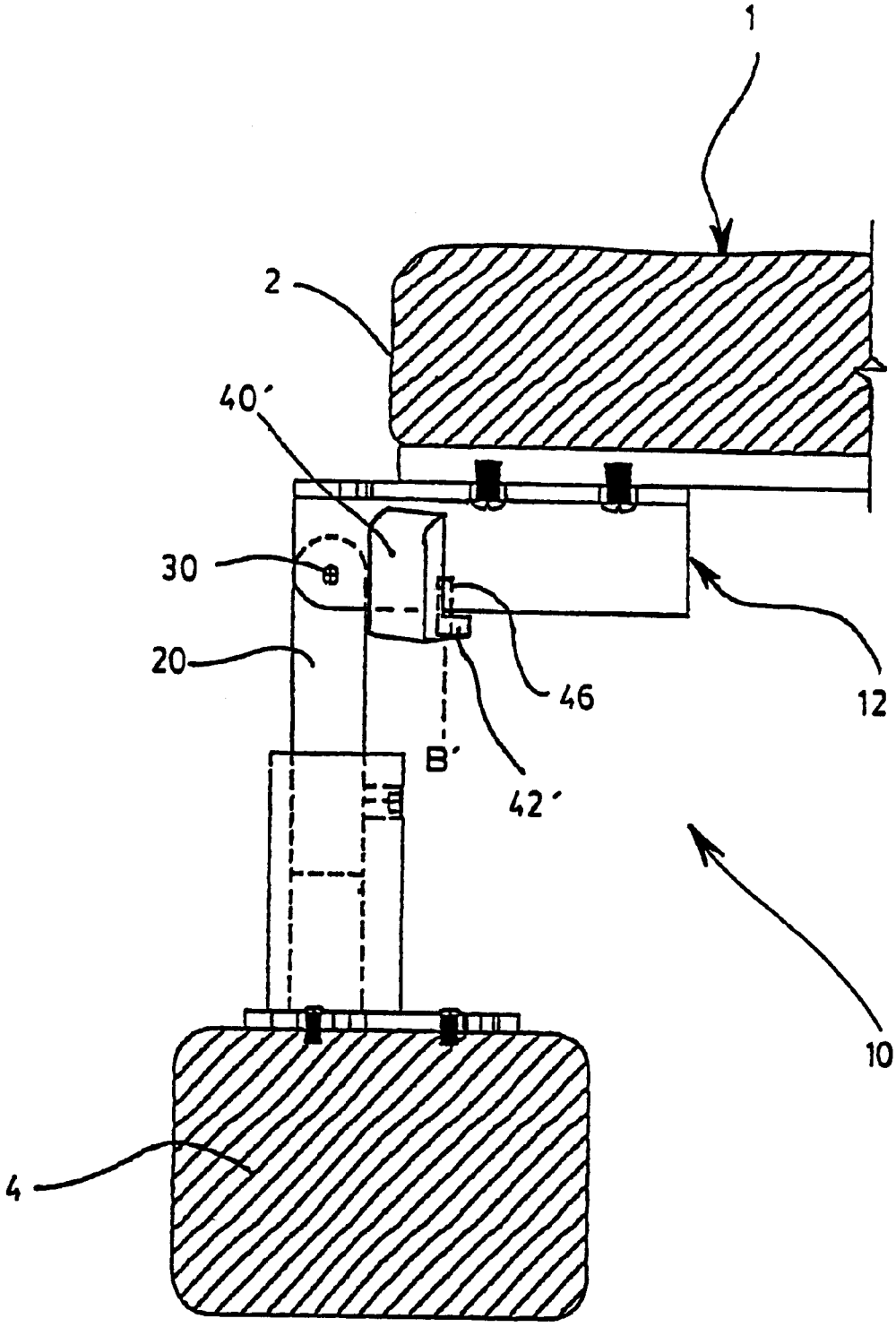
FIG. 8 a side elevational view of the support shown in FIG. 7, where the rod is in the released position.
Figure 9:
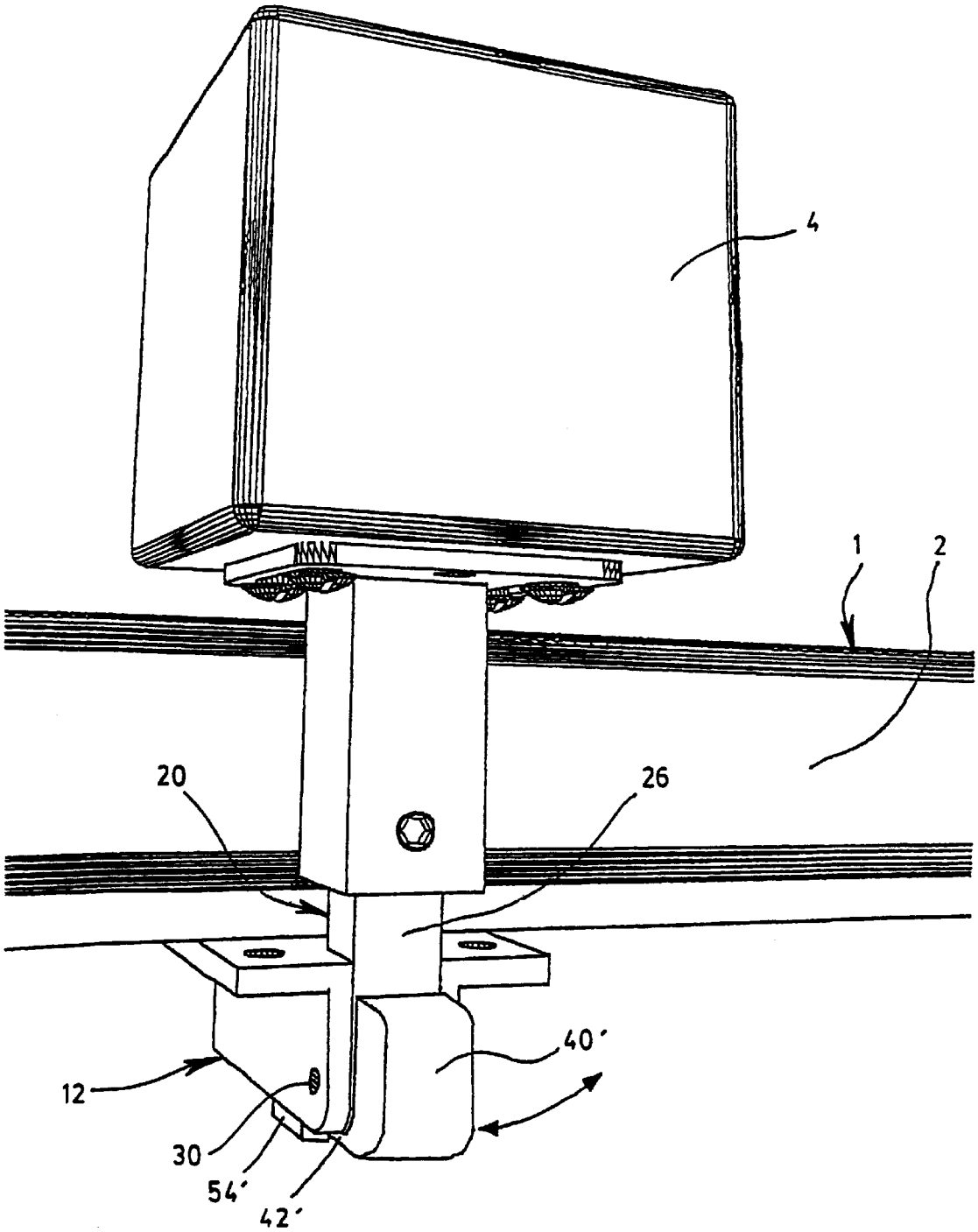
FIG. 9 is a side front perspective view of the pivotable abduction abutment support shown in FIGS. 7 and 8, mounted on a wheelchair seat.

In a second preferred embodiment of the invention shown in FIGS. 7 to 9, the elements of the locking means are numbered with a prime after the number. Thus, the locking means according to the second preferred embodiment comprise (i) a retaining portion (40'), (ii) an arm (42') extending rearwardly from the retaining portion (40') and having a distal end (44' shown in FIG. 7) mounted about a second pivot (46' shown in FIGS. 7 and 8 only); the second pivot (46') having a pivoting axis B'.

According to the second preferred embodiment of the invention and referring more particularly to FIGS. 7 and 8, the pivoting axis B' of the second pivot (46') is vertical, i.e. orthogonal to a horizontal plane in which the pivoting axis A of the first pivot (30) extends.

In the second preferred embodiment, the biasing means is preferably a spring (not shown) coiled around the pivot (46') in a similar fashion to the spring (50) illustrated in FIG. 6. To stop the retaining portion (40') in front of the front surface (26) of the rod (20), the base member (12) is provided with a stopper (54') shown in FIG. 9.

In the first preferred embodiment of the invention shown in FIGS. 1 to 6, the biasing means bias the retaining portion (40) upwardly and for setting the rod (20) free, the retaining portion (40) has to be pivoted down. Whereas, in the second preferred embodiment of the invention shown in FIGS. 7 to 9, the biasing means bias the retaining portion (40') toward the left side, and thus, for setting the rod (20) free, the retaining portion (40') has to be pivoted toward the right side.

Although not shown, the pivotable abduction abutment support (10) according to the present invention can comprise extending means (not shown) for extending forwardly the base member (12) in order to adjust horizontally the distance between the abutment (4) and the wheelchair user. These extending means can be embodied in a rail system interconnecting two parts of the base member (12), or in a telescopic fastening means for horizontally extendingly fastening the base member (12) under the wheelchair seat (1). Other extending means known in the art may be used in combination with the disclosed support (10) without departing from the scope of the present invention.

Also not shown, the pivotable abduction abutment support (10) according to the present invention can comprise moving means (not shown) for laterally moving the base member (12) in order to laterally adjust the abutment (4) along the front edge (2) of the seat (1).

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention as defined in the appended claims.

What is claimed is:

1. A pivotable abduction abutment support for a chair, the chair having a seat, the support comprising:

a base member adapted to be fastened under the seat, the seat having a front edge, the base member having a front end extending beyond the front edge of the seat;

a rod having two opposite ends, a front surface and a rear surface, one of the opposite ends being mounted about a first pivot located at the front end of the base member, the first pivot having a pivoting axis parallel to the front edge of the seat, wherein the rod pivots between an upstanding position where the rod extends upwardly and substantially vertically, and a released position where the rod extends downwardly;

abutment fastening means for fastening an abutment to the other opposite end of the rod so that the abutment extends above the seat when the rod is in the upstanding position; and releasable locking means for releasably locking the rod in the upstanding position, the locking means comprising:

(i) a retaining portion for engaging the front surface of the rod, the retaining portion lying above the first pivot in order to lock the rod in the upstanding position, (ii) at least one arm extending rearwardly from the retaining portion, the arm having a distal end mounted about a second pivot located on the base member rearwardly of the first pivot, and (iii) biasing means for biasing the retaining portion against the rod, whereby, by manually pivoting the retaining portion away from the rod, the rod is released and free to pivot downwardly; and when the rod is pivoted from the released position to the upstanding position, the biasing means automatically pivot the retaining portion towards the rod to engage the front surface of the rod and thereby lock the rod in the upstanding position.

2. A pivotable abduction abutment support according to claim 1, wherein the second pivot has a pivoting axis parallel to the pivoting axis of the first pivot.

3. A pivotable abduction abutment support according to claim 2, wherein the front end of the base member has a front surface and a lower surface, the front surface being inwardly rounded towards the lower surface.

4. A pivotable abduction abutment support according to claim 2, wherein the base member has two opposite sides and comprises at least one flange laterally extending from an upper edge of an opposite side of the base member, whereby the flange prevents the locking means from pivoting upwardly beyond a horizontal position.

5. A pivotable abduction abutment support according to claim 2, wherein the second pivot is also located above of the first pivot.

6. A pivotable abduction abutment support according to claim 2, wherein the at least one arm of the releasable locking means comprises two arms extending rearwardly from two opposite sides of the retaining portion so that the locking means define a U shape.

7. A pivotable abduction abutment support according to claim 6, wherein the front end of the base member has a front surface and a lower surface, the front surface being inwardly rounded towards the lower surface.

8. A pivotable abduction abutment support according to claim 6, wherein the base member has two opposite sides and comprises two flanges laterally extending from an upper edge of the two opposite sides of the base member respectively, whereby the flanges prevent the locking means from pivoting upwardly beyond a horizontal position.

9. A pivotable abduction abutment support according to claim 1, wherein the second pivot has a vertical pivoting axis.

10. A pivotable abduction abutment support for a chair, the chair having a seat, the support comprising:

a base member adapted to be fastened under the seat, the seat having a front edge, the base member having a front end extending beyond the front edge of the seat, the front end having a front surface and a lower surface where the front surface is inwardly rounded towards the lower surface, the base member having two opposite sides;

a rod having two opposite ends, a front surface and a rear surface, one of the opposite ends being mounted about a first pivot located at the front end of the base member, the first pivot having a pivoting axis parallel to the front edge of the seat, wherein the rod pivots between an upstanding position where the rod extends upwardly and substantially vertically, and a released position where the rod extends downwardly;

abutment fastening means for fastening an abutment to the other opposite end of the rod so that the abutment extends above the seat when the rod is in the upstanding position;

releasable locking means for releasably locking the rod in the upstanding position, the locking means comprising:

(i) a retaining portion for engaging the front surface of the rod, the retaining portion lying above the first pivot in order to lock the rod in the upstanding position, (ii) two arms extending rearwardly from two opposite sides of the retaining portion so that the locking means defines a U-shape, each arm having a distal end mounted about a second pivot located on the base member rearwardly and upwardly of the first pivot, the second pivot having a pivoting axis parallel to the pivoting axis of the first pivot, and (iii) biasing means for upwardly biasing the retaining portion, whereby, by manually pivoting down the retaining portion, the rod is released and free to pivot downwardly; and when the rod is pivoted from the released position to the upstanding position, the biasing means automatically pivot the retaining portion upwardly to engage the front surface of the rod and thereby lock the rod in the upstanding position; and two flanges laterally extending from an upper edge of the two opposite sides of the base member respectively, whereby the flanges prevent the locking means from pivoting upwardly beyond a horizontal position.

* * * * *